United States Patent [19]

Hynes et al.

[11] Patent Number: 4,513,823

[45] Date of Patent: Apr. 30, 1985

[54] CYLINDRICAL GATE VALVE APPARATUS AND METHOD

[75] Inventors: Joseph H. Hynes, Houston; Charles D. Morrill, Humble, both of Tex.

[73] Assignee: Hydril Company, Los Angeles, Calif.

[21] Appl. No.: 549,201

[22] Filed: Nov. 4, 1983

[51] Int. Cl.[3] ..... E21B 33/02; E21B 43/12; F16K 31/00

[52] U.S. Cl. ..... 166/386; 166/97; 166/316; 166/330; 251/229; 251/296

[58] Field of Search ..... 166/75 R, 86, 88, 92, 166/93, 95, 97, 316, 330, 332, 379, 386, 279, 373; 251/229, 296, 309, 312; 137/625.47

[56] References Cited

U.S. PATENT DOCUMENTS

| | | | |
|---|---|---|---|
| 1,077,697 | 11/1913 | Gates | 137/625.47 |
| 1,092,441 | 4/1914 | Heggem | 137/625.47 |
| 2,331,557 | 10/1943 | Lorehn et al. | 251/159 |
| 2,475,702 | 7/1949 | Fimke | 210/166 |
| 2,766,830 | 10/1956 | Church | 166/86 |
| 3,036,807 | 5/1962 | Lucky et al. | 251/28 |
| 3,076,509 | 2/1963 | Burns et al. | 166/330 |
| 3,721,265 | 3/1973 | Hoffland | 137/625.47 |
| 3,729,170 | 4/1973 | Lewis et al. | 251/315 |
| 3,799,191 | 3/1974 | Burkhardt et al. | 137/454.2 |
| 3,887,010 | 6/1975 | Sizer et al. | 166/314 |
| 3,976,102 | 8/1976 | Crocker | 137/625.47 |
| 4,113,228 | 12/1978 | Frye | 251/309 |

*Primary Examiner*—Stephen J. Novosad
*Assistant Examiner*—Bruce M. Kisliuk
*Attorney, Agent, or Firm*—Dodge & Bush

[57] ABSTRACT

A safety valve is disclosed which may be installed on an offshore wellhead above the tubing head and below the Christmas tree. The valve has a housing with upper and lower vertical passages and a lateral housing passage. A cylindrical gate is disposed within the lateral passage and includes a "T" shaped passage therein. The gate may be moved laterally and angularly within the lateral passage. During completion or workover of the well, the gate is moved laterally until the upper and lower vertical passages are in full open communication to run drills, hangers or other large diameter devices into the well via a BOP which may be attached to the top of the housing. During normal production, the gate may be laterally moved into the intersection of the vertical and lateral passages and the small through head part of the "T" passage serves to provide a vertical flow path through the production bore which is sealed off from the larger upper and lower vertical passages. Flow through side outlets in the housing is possible through the base of the "T" passage. The gate may be angularly moved to have production to the lateral outlets via the head part of the "T" when the base part of the "T" is aligned with production tubing. Should the need arise, the valve may be angularly rotated to a position where the fluid flow path of the production tubing is completely shut in.

18 Claims, 10 Drawing Figures

FIG. 4
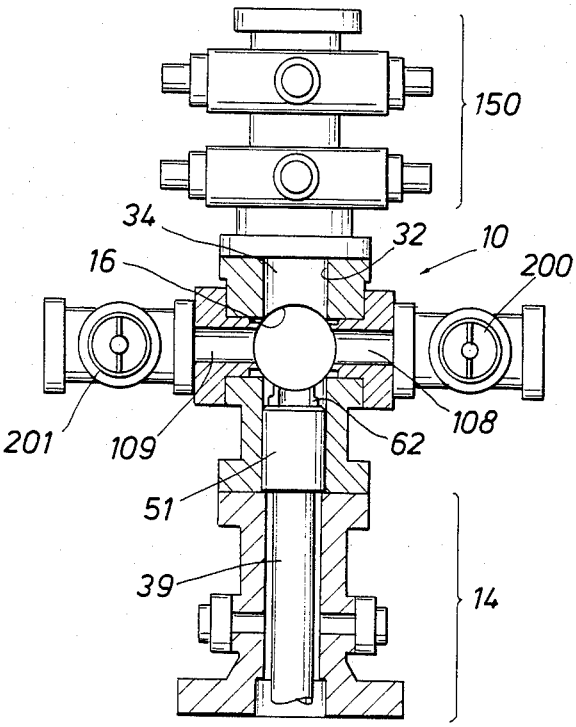
FIG. 5
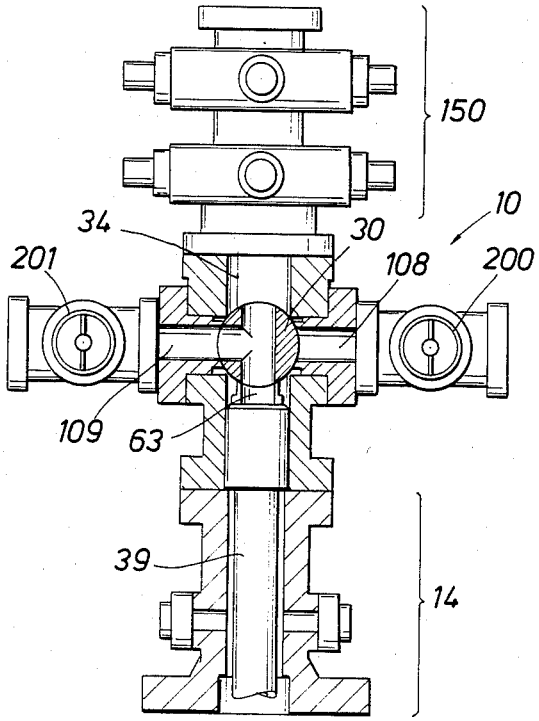
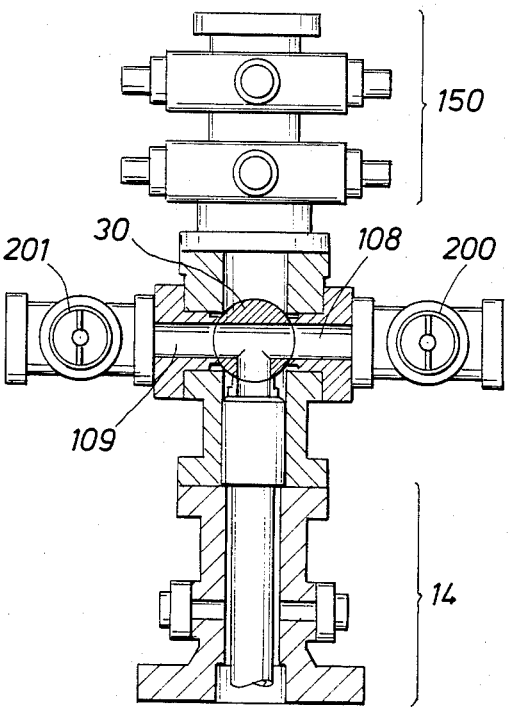
FIG. 7
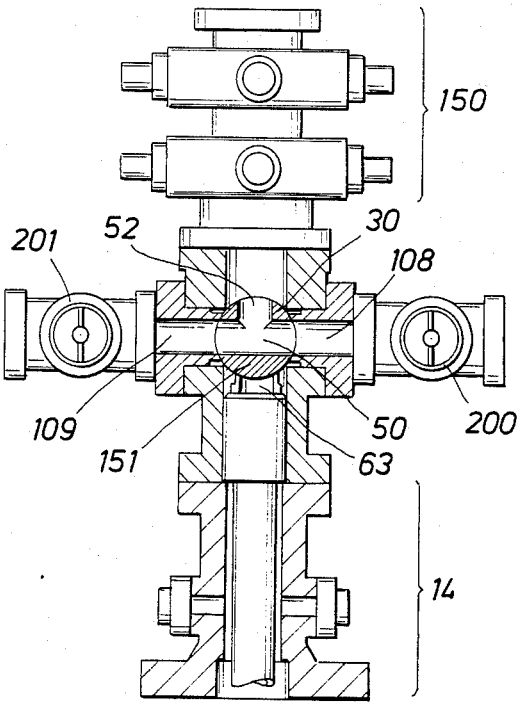
FIG. 6

FIG. 8
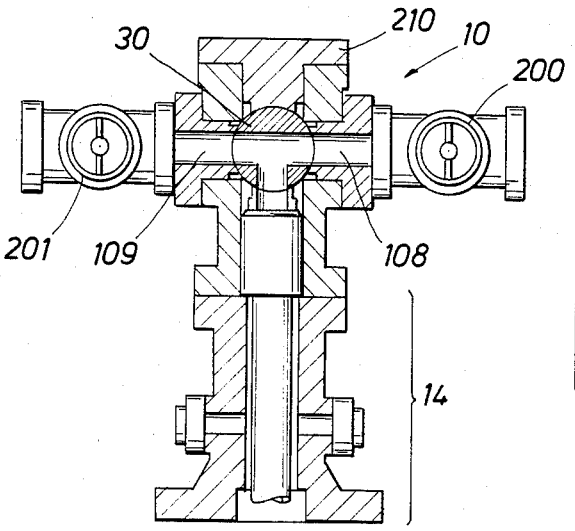
FIG. 10
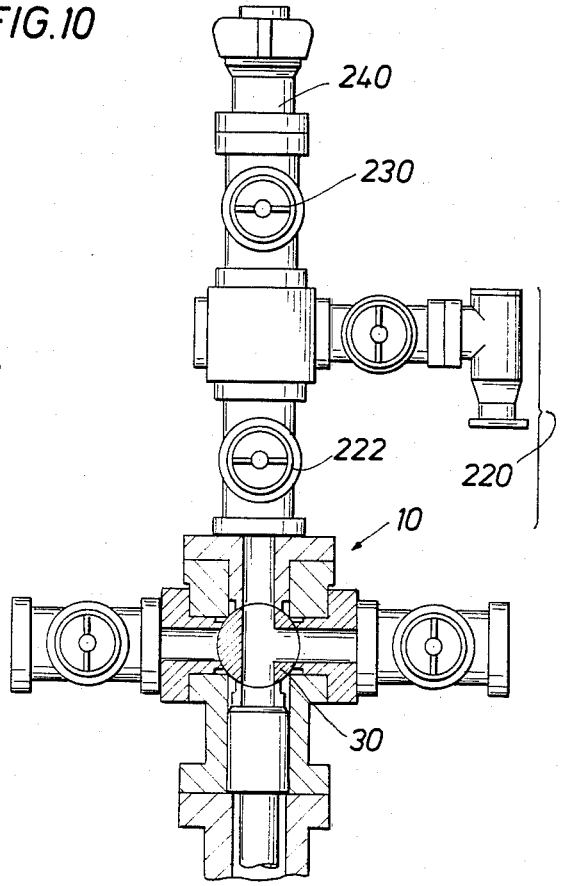
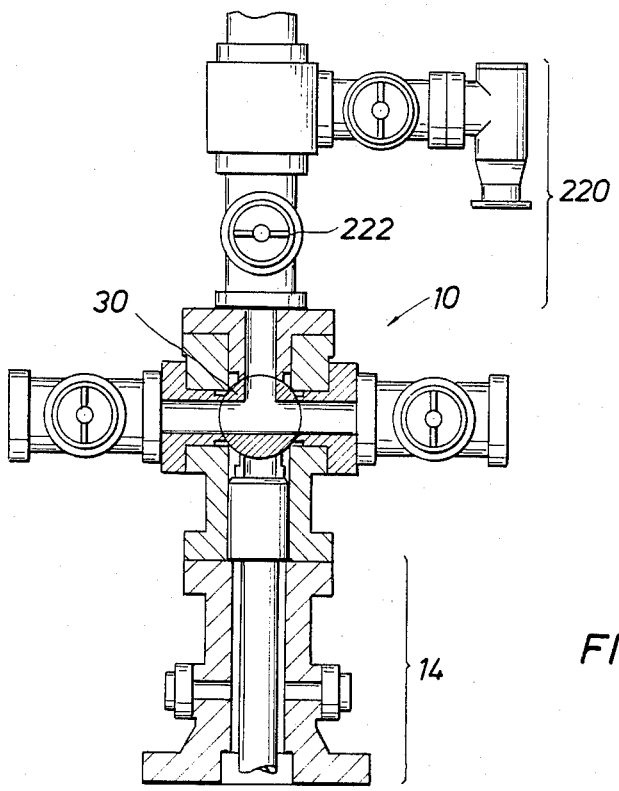
FIG. 9

CYLINDRICAL GATE VALVE APPARATUS AND METHOD

BACKGROUND OF THE INVENTION

1. Field of the Invention

The invention generally relates to a valve which may be used as a master valve for a production well, or alternatively as a safety or blowout preventer valve between a tubing head and a production (Christmas) tree. The invention also generally relates to valve apparatus providing complete control over a well during installation or workover of tubing in an oil or gas well.

More specifically, the invention, in its blowout preventer embodiment, is directed for use on offshore production platforms where a plurality of producing oil wells are disposed in close proximity to one another and where there is an emergency need to simultaneously shut in all the producing wells rapidly, safely, reliably, and economically while facilitating rapid resumption of production after the emergency has passed.

The invention may also serve as a substitute for a master valve in production wells where a vertical production tree is eliminated in favor of horizontal plane apparatus.

2. Description of the Prior Art

On marine production platforms there are often many producing wells in close proximity to one another. Each of the wells typically has a production wellhead from which production tubing extends into the well. The wellhead typically has a production or "Christmas" tree connected to it for controlling the gas or fluid flowing in the production tubing during production of the well. A master gate valve disposed in each production tree may be closed to shut off flow from the well, but such gate valves may be difficult to close rapidly during an emergency due to their location, and indeed may not be available as where the production tree is removed from the wellhead during workover of the well.

Downhole safety valves may also be provided in each of the producing wells; but there is always the danger that a downhole safety valve may not be operable or in place during workover of the well. As indicated above, during workover, the production tree may have been removed in order to install a blowout preventer stack atop the production wellhead for control of the well during workover. Such a blowout preventer stack is of the kind used typically in drilling operations and includes one or more ram-type blowout preventers and an annular blowout preventer. Until the blowout preventer is installed on the production wellhead and connected to its controls, well control in the past for the well has depended upon remotely installed plugs in the well. Such plugs have not always been reliable.

During an emergency on an offshore platform, for example, where a fire or leaking gas or fluid from one production tree endangers all of the wells and indeed the platform itself, there has developed the need for an apparatus and method for its installation and refurbishing which may be used to rapidly close off the flow path of the production tubing in each of the wells.

As indicated above, a shear ram blowout preventer similar to those used in marine blowout preventer stacks for drilling operations could be a candidate for satisfying such a need. The use of a shear ram blowout preventer has a major disadvantage in that the tubing above the tubing hanger must be replaced after it has been sheared before production can be resumed. Shear ram blowout preventers crush the production tubing which must be replaced before the well can be put back into operation. In order to replace the crushed tubing, the production tree must be removed and a drilling blowout preventer and rig installed in order to remove the damaged tubing and replace it with new tubing.

Another disadvantage of using a shear ram blowout preventer similar to that used in drilling operations is that after the preventer crushes and shears the tubing, the well can only be controlled by pumping mud into it to control the pressure in the well. A plug typically cannot be installed through the tubing which has been crushed during the shearing by the preventer.

IDENTIFICATION OF OBJECTIVES OF THE INVENTION

Thus, it is an important objective of the invention to provide apparatus intermediate a wellhead and a Christmas tree serving as a safety valve which does not crush the tubing extending into the well.

Another important object of the invention is to provide apparatus for controlling the well during removal of a blowout preventer atop the apparatus and while it is being replaced with a Christmas tree.

Another object of the invention is to provide an apparatus and method for controlling the well at all times, in conjunction with a blowout preventer atop the apparatus, while installing or working over production tubing in the well.

A key objective, in other words, is to provide continuous uninterrupted security for a well to which it is attached from the time prior to running production tubing to the final abandonment of the well.

Another key objective of the invention is to provide apparatus which does not destruct part of the apparatus, and thus provides a safety means for operating personnel to use during operations on the well in which they do not hesitate to use for fear of having to later replace a part during a time consuming procedure. In still other words, it is an objective of the invention to provide a safety valve which is entirely reversable without destruction of tubing or valve parts.

Most Christmas trees are vertically oriented; that is, a master valve is provided in a spool attached to the wellhead. Control valves are then provided laterally from the spool above the master valve. The well is produced and controlled through the control valves.

Some wells demand that the vertical height of the Christmas tree be minimized. For example, in a shallow subsea completion, it is desirable to minimize the height of the tree so that vessels passing above will not contact the tree during extremely low tide conditions. Another example is where the tree height must be minimized for esthetic reasons, say in a city.

Thus, another important objective of the invention is to provide an apparatus which may serve as a master valve of a production tree where control valves may be disposed at the same height as that of the master valve.

SUMMARY OF THE INVENTION

The general objects of the invention as outlined above are provided, as well as other important features and advantages of the invention, are described in the summary of the invention which follows. A more specific object of the invention is to provide a producing well safety valve in which no element is replaced and in which the production tubing is not disturbed after the valve has been closed and which does not require that the production tree be removed after the valve has been closed.

Another object of the invention is to provide a safety valve in a producing well which can be immediately put back into production after the valve has been closed.

Another object of the invention is to provide a safety valve for use in a producing well in which access to the production tubing is available via a blowout preventer attached to its top.

Another object of the invention is to provide valve apparatus which enables the production tubing to be connected directly to a lateral valve line.

Yet another object of the invention is to provide apparatus useful during loss of control over the well to regain control over the well by lateral access to the production tubing in order to carry out any of a wide range of procedures such as circulation, bullheading, pressure relieving, killing, etc., prior to vertical re-entry of the well.

It is still another object of the invention to provide an apparatus and method for controlling the well during completion of the tubing into the well or during workover at the time that the blowout preventer stack is removed in order to install the Christmas tree or vice versa.

It is another object of the invention to provide complete control over the well during wireline operations at any stage of the operations in a production well.

According to the invention, a safety valve is provided which is adapted for placement above a wellhead. The housing of the valve has coaxial upper and lower vertical housing passages. The diameter of the upper and lower passages are sufficiently large to pass a tubing hanger with tubing or the like for landing in the wellhead. A control element means is provided for placement between the upper and lower vertical housing passages for preventing or allowing fluid through a passage smaller than the lower vertical housing passage and for providing full diametrical access via the upper housing passage to the lower housing passage.

The control element preferably is a cylindrical gate or ram disposed in a lateral housing passage which intersects the vertical housing passage. The gate has a first gate passage disposed through it having a diameter smaller than that of the vertical housing passage.

Means are provided for laterally moving the gate within said lateral passage between two lateral positions. The first lateral position is where the gate is in the intersection of the vertical housing passage and the lateral housing passage. The second lateral position is where the gate is out of the intersection of the vertical housing passage, thereby allowing full diameter access through the vertical housing passage.

Means are provided for angularly rotating the cylindrical gate when it is in the first lateral position for angularly orienting the gate between at least two angular positions. The first angular position is where the first gate passage is coaxial with the vertical housing passage thereby allowing fluid flow from the lower portion of the vertical housing passage to an upper portion of the vertical housing passage via the first gate passage. The second angular position is where a portion of the gate having no passage through it prevents upward fluid flow from a lower portion of the vertical housing passage via the gate passage.

Means are provided in the valve described above for disposing upper and lower conduits in the vertical housing passage where the upper conduit has its lower end open to the intersecting lateral passage and the lower conduit has its upper end open to the intersecting lateral passage. When the gate is in the first lateral position and in the first angular position, the first gate passage is aligned with the upper and lower conduits and a upward flow path is established through the upper and lower conduits and the gate passage. When the gate is in the first lateral position and the second angular position, upward flow from the lower conduit is prevented.

According to the invention, one lateral outlet may be provided in the housing where the lateral outlet is substantially perpendicular to the vertical housing passage and the lateral housing passage and is open to the intersection of the lateral housing passage and the vertical housing passage. A second gate passage is provided perpendicular to and communicating with the first gate passage. The first and second gate passages form a "T" shaped passage, the first gate passage forming the head of the "T" and the second gate passage forming the base of the "T". When the gate is in the first lateral position and in the first angular position, the second gate passage is aligned with the lateral outlet.

A second lateral outlet may be provided in the housing where the second lateral outlet is substantially perpendicular to the vertical housing passage and to the lateral housing passage and is open to the intersection of the lateral housing and the vertical housing passage and is spaced one hundred-eighty degrees about the housing from the first lateral outlet. The angular rotating means is adapted to rotate the cylindrical gate among the first and second positions and a third position where the head of the "T" shaped passage is aligned with the first and second lateral outlets and the base of the "T" shaped passage is aligned with the lower conduit. Diverter valves may be attached to one or both of the lateral outlets.

The safety valve described above may be used as a horizontal production tree where the valve is used as a master valve for connection to the tubing head of the well. Control valve means such as diverter valves may be attached to the lateral outlets for controlling fluid flow in the production tubing in the well. Means may be provided for attaching a blowout preventer to the upper passage of the housing or for capping the vertical housing passage of the housing when used in the production mode.

A method for controlling the well during installation of production tubing and a Christmas tree is provided, according to the invention, where a blowout preventer is attached to the upper vertical housing passage of the valve. The method comprises the steps of first setting tubing in the well through the blowout preventer and upper and lower vertical housing passages of the safety valve while the cylindrical gate is in the second lateral position. The gate is then moved laterally to the first lateral position and the gate is angularly moved to the second angular position until the vertical fluid flow path to the upper vertical housing passage from the tubing is closed. The blowout preventer is then removed from the upper part of the housing and a Christmas tree is installed to the upper part of the housing. The gate is then angularly moved to the first angular position where the first gate passage completes the vertical flow path from the tubing in the wellhead below to the Christmas tree above the safety valve housing.

Where a "T" shaped passage is formed in the gate, the step of angularly moving the gate to the second angular position to close the fluid flow path to the upper vertical housing passage comprises moving the gate angularly within the lateral passage until the head passage of the "T" is aligned with the lateral outlets from the housing and the base passage of the "T" is aligned with the tubing and a portion of the upper surface of the gate having no passage extending through it covers the flow path to the upper passage of the housing. The method further includes the step of opening one or both of the diverter valves connected to the lateral outlets whereby fluid in the tubing may be diverted away from the wellhead.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIGS. 4 through 7 show the valve according to the invention disposed between a wellhead and a blowout preventer and illustrate the various lateral and angular positions that the gate may take for controlling the well after tubing has been provided in the lower vertical passage through the blowout preventer;

FIG. 8 illustrates the valve used as a master valve of a horizontal production tree and where the control valve or lateral or wing valve connected to the lateral outlets of the valve;

FIG. 9 illustrates the valve after a blowout preventer has been removed and a vertical Christmas tree has been attached to the top of the valve; and FIG. 10 illustrates the valve with a vertical Christmas tree and a swab valve and adapter attached to the top thereof for swabbing or wireline work through the tubing.

DESCRIPTION OF THE INVENTION

Figure 1:
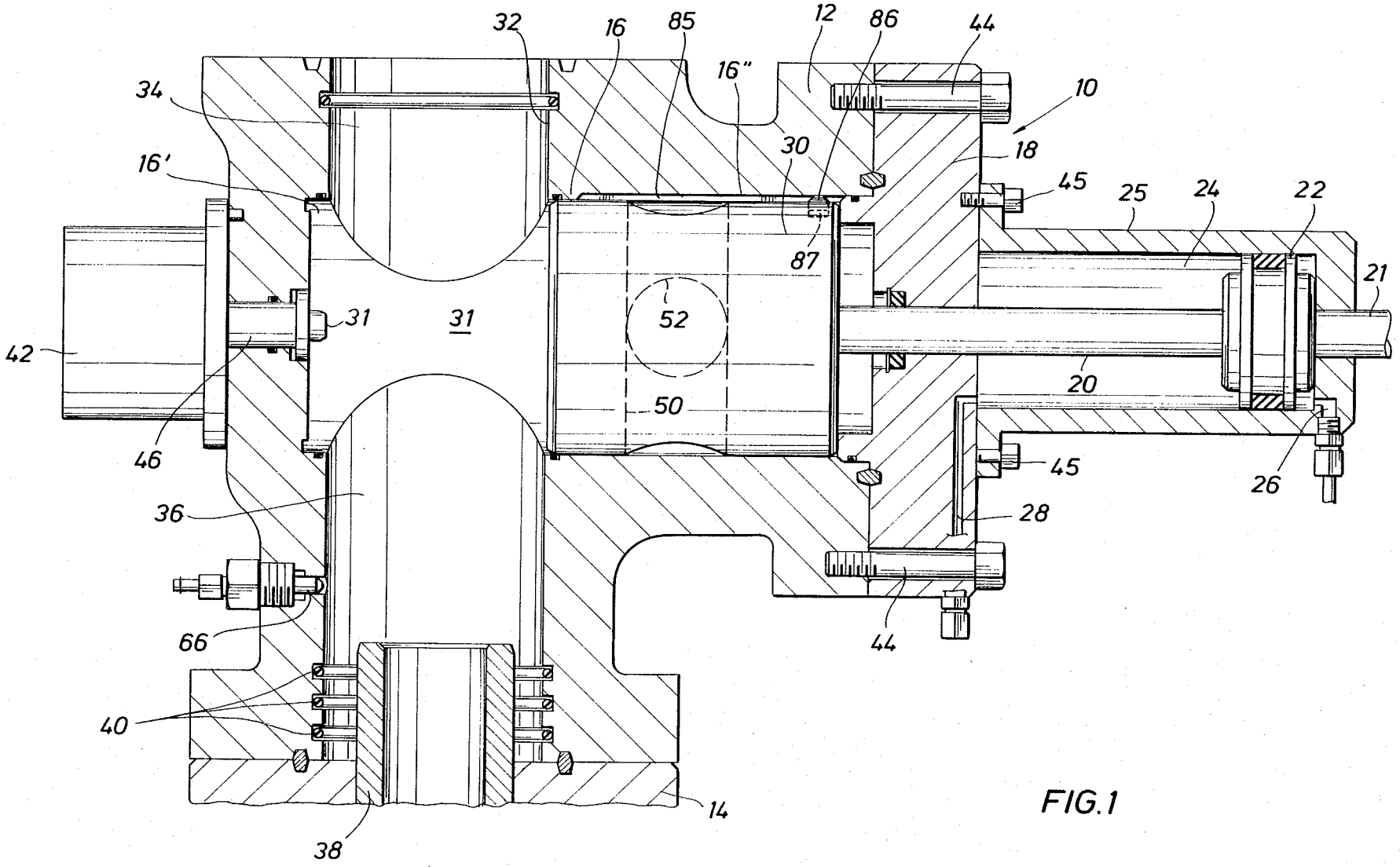
FIG. 1 is a cross-section of the valve according to the invention showing a housing having vertical and lateral passages and a cylindrical gate disposed in a lateral housing out of the intersection of the lateral housing and the vertical housing providing vertical access from the upper part of the vertical passage to the lower part of the vertical passage.

FIG. 1 illustrates the valve 10 in cross-section having a housing 12 with a vertical passage 32 and a lateral passage 16 intersecting the vertical passage 32. The lateral passage has a relatively larger portion 16'' extending laterally outwardly to the right as illustrated in FIG. 1 and a relatively smaller portion 16' extending laterally to the left in the illustration of FIG. 1. The housing 12 is illustrated as being attached to a well head 14 having a tubing hanger 38 disposed therein. Seals 40 for sealing about a tubing hanger pack-off are also provided.

A cylindrical gate member 30 is shown disposed in a second lateral position where the gate 30 is within the larger portion 16'' of the lateral housing passage 16 and is out of the intersection 31 of the lateral passage 16 and the vertical passage 32.

As illustrated by dashed lines, the gate 30 preferably has a through bore 50 and a perpendicular bore 52 (illustrated in greater detail in FIG. 3) forming a "T" shaped bore, where the head of the "T" shaped passage is the through bore 50 and the intersecting perpendicular bore 52 is the base of the "T" shaped passage.

Figure 2:
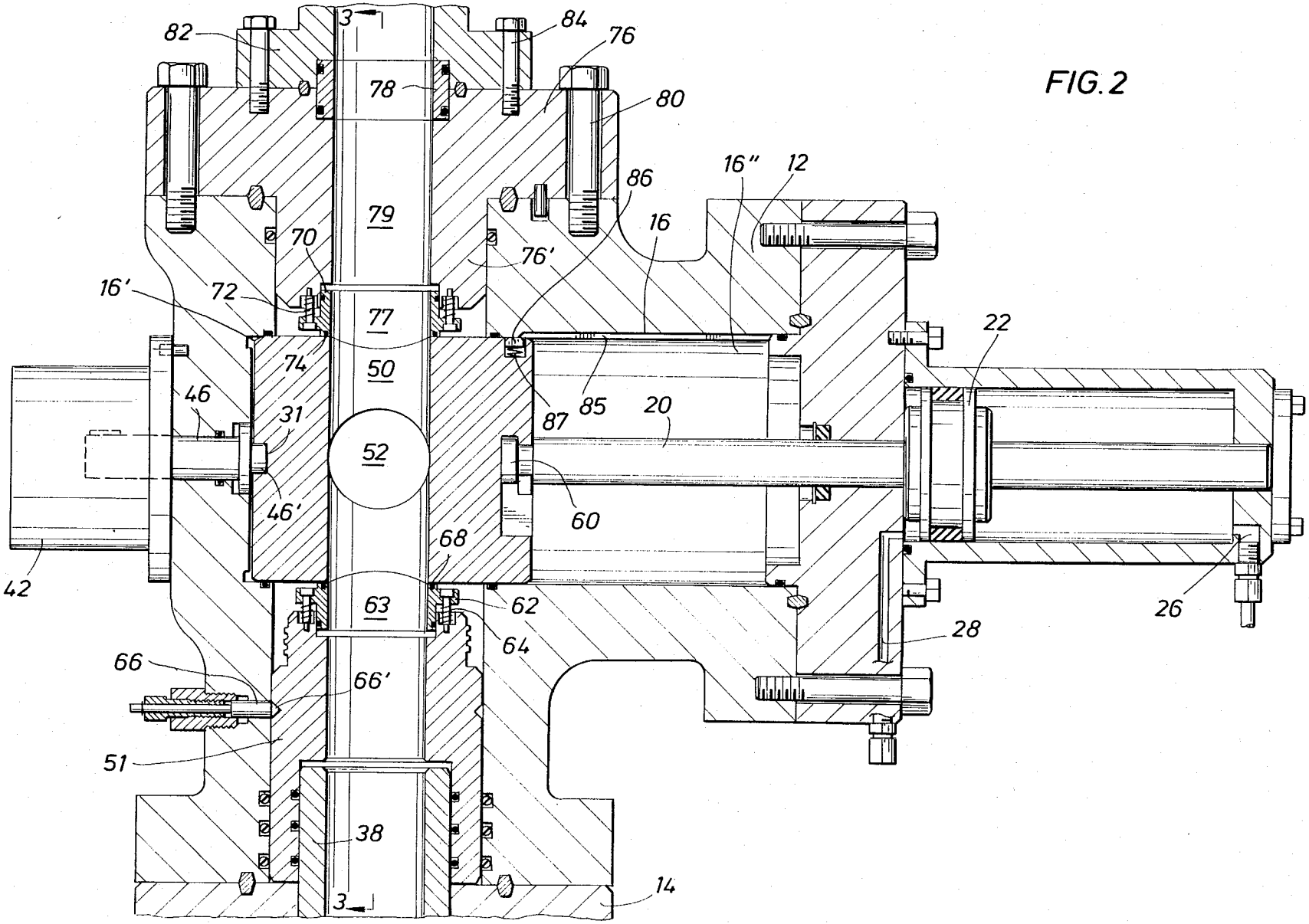
FIG. 2 is a cross-section of the valve illustrated in FIG. 1 after a tubing hanger pack-off and tubing have been disposed in the lower vertical passage and the cylindrical gate has been moved into the intersection of the vertical housing passage and the lateral housing passage and after an adapter flange has been attached to the upper part of the housing.

Means for laterally reciprocating the gate 30 from the second position illustrated in FIG. 1 to a first position as illustrated in FIG. 2 in the intersection 31 of the vertical passage 32 and the lateral passage 16 is provided and comprises a rod 20 coupled to the gate 30 and a piston 22 and a piston chamber 24. The lateral moving means further comprises a bonnet 18 attached to the housing 12 by means of threaded bolts 44 and the housing 25 for the piston chamber 24 attached to the bonnet by means of bolts 45. The piston 22 and rod 20 reciprocates the gate 30 by providing pressurized hydraulic fluid via the input hydraulic port 26 which forces the piston 22 and rod 20 laterally to the left driving any hydraulic fluid in the piston chamber 24 out via the exit port 28. Of course the piston 22 and rod 20 may be driven laterally to the right in the illustration of FIG. 1 by reversing the process, that is, by applying pressurized hydraulic fluid via the exit port 28 and whereby any remaining fluid to the right of the piston 22 is driven outwardly via the input hydraulic port 26. Although not illustrated in FIG. 1, a manual means may be provided for the rod extension 21 for manually reciprocating the gate 30 from its second position, as illustrated, to a first position in the intersection 31 of the lateral housing passage 16 and the vertical housing passage 32.

A rotary actuator 42 coupled to a rotary actuator shaft 46 is provided at the end of the smaller portion 16' of the lateral housing passage 16 to cooperate with the end of the gate 30 once the end of the gate 30 is moved laterally to the left into smaller portion 16'.

A keyway 85 is provided in lateral passage 16 forming a guideway groove in housing 12 to cooperate with key 86 disposed in gate 30. Key 86 is urged outwardly into keyway 85 and serves to maintain gate 30 in the proper angular orientation necessary for engaging shaft extension 46' of rotary actuator shaft 46 after gate 30 has been moved laterally to the left. As illustrated in FIG. 2, slot 30' in the end of gate 30 has engaged shaft extension 46' and key 86 has moved out of keyway 85 because of the lateral movement ot the left of gate 30. The gate 30 is now free to be angularly rotated within vertical housing passage 16 under the motive force of rotary actuator 42 via the coupling of slot 30' with shaft extension 46'.

FIG. 2 illustrates the condition of the valve 10 after a tubing hanger pack-off 51 and lower coupling member 62 have been landed in the lower vertical passage 36. Latching dogs 66 are provided for movement into a slot 66' in the tubing hanger pack-off 51. The lower coupling member 62 is urged upwardly against the wall of the cylindrical gate member 30 by spring means 64. A seal 68 provides a sealed surface between the lower coupling member 62 and the exterior wall of the gate member 30. Thus, a bore 63 is provided from the lower coupling member 62 through the tubing hanger pack-off 51 and tubing hung in the tubing hanger 38.

As illustrated in FIG. 2, the gate 30 is disposed in the intersection between the lateral housing passage 16 and the vertical housing passage 32. The end of the gate 30 is coupled to a shaft extension 46' of the rotary actuator shaft 46. The shaft extension 46 and slot 31 cooperate to provide a means for rotating the gate 30 while in the first lateral position illustrated in FIG. 2.

FIG. 2 also illustrates the connection of an adapter flange 76 in which an adapter flange extension 76' having a bore 79 through it extends downwardly toward the upper cylindrical surface of the gate 30. An upper coupling member 70 is urged downwardly by way of spring means 72 bearing downwardly from adapter flange extension 76'. A seal 74 provides sealing about the exterior surface of the cylindrical gate 30. A vertically extending base of coaxial bores 77 and 79 are provided through the upper coupling member 70 and through the adapter flange 76 as illustrated.

Adapter flange 76 may be connected to the housing 12 by means of bolts 80. A vertical extension of bore 79 may be provided to a valve flange 82 of a blowout preventer or a Christmas tree by means of a head sleeve 78. The valve flange 82 may be connected to the adapter flange 76 by means of bolts 84.

As illustrated in FIG. 2, the cylindrical gate 30 in the second lateral position as illustrated has its through bore 50 or the head of the "T" passage provided in alignment with the bore 63 of the lower coupling member 62 and the tubing below and the bore 77 of the upper coupling member 70 and the bore 79 extending above, for example, to a Christmas tree. FIG. 2 also illustrates that the piston 22 has been moved laterally to the left from that illustrated in FIG. 1 and that the rod 20 has been moved laterally to the left for providing the gate 30 in the second lateral position. Also illustrated is a coupling means 60 by which the rod 20 is coupled to the gate 30 for lateral reciprocation.

Figure 3:
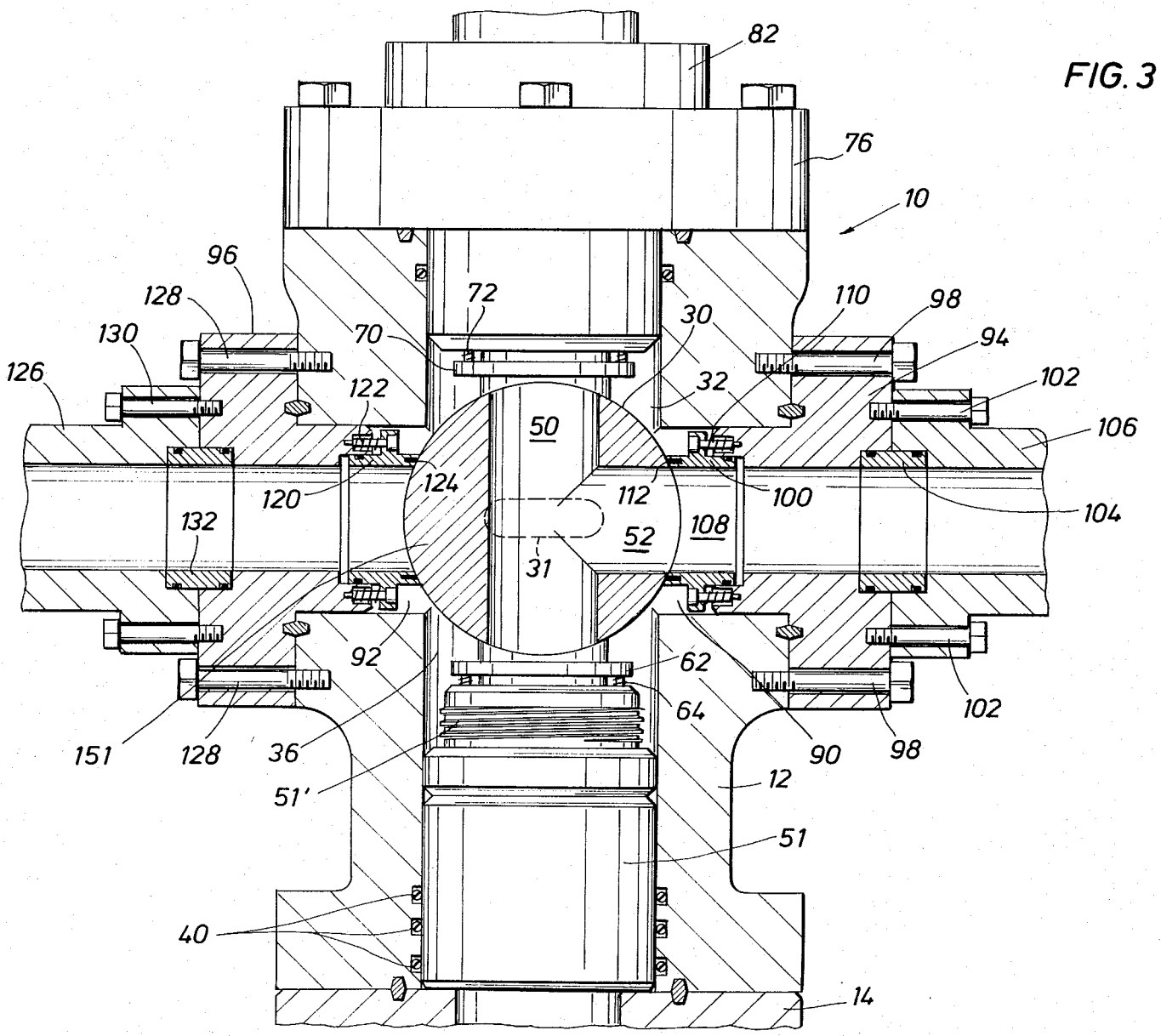
FIG. 3 illustrates the valve partially in cross-section taken through lines 3—3 of FIG. 2 and illustrating lateral outlets of the valve and further illustrating a "T" shaped passage in the gate.

FIG. 3 illustrates the safety valve 10 according to the invention partially in cross-section taken through lines 3—3 of FIG. 2 and partially in elevation. The tubing hanger packoff 51 is shown disposed in the lower vertical passage 36 within the housing 12. Threads 51' are illustrated which may be used with a running tool (not illustrated) for placing or removing the tubing hanger packoff 51 in the housing via the vertical housing passage 32. The lower coupling member 62 and upwardly urging spring means 64 are illustrated as are the upper coupling member 70 and downwardly urging spring means 72. Thus, a through vertical flow passage is created via the through bore 50 of the gate 30 from the tubing in the tubing hanger pack-off into the wellhead and the vertical bore extending vertically through a valve flange 82. A vertical Christmas tree may be provided atop the valve 10 for vertical production of the well.

Also illustrated in FIG. 3 are lateral housing outlets 90 and 92 which are provided perpendicularly to the vertical housing passage 32 and to the lateral housing passage 16. Conduit adapter flanges 94 and 96 are attached to the housing 12 by means of bolts 98 and 128, respectively. Lateral cylindrical seats 100 and 120 are provided for sealing and seating about the cylindrical gate 30 exterior surface providing conduit bores 108 and 109 through the cylindrical seats 100 and 120 and the conduit adapter flanges 94 and 96. Spring means 110 and 122 urge the lateral cylindrical seats 100 and 120, respectively, inwardly toward the exterior surface of the cylindrical gate. Seals 112 and 124 provide sealing between the exterior wall of the gate 30 and the conduit bores 108 and 109. Lateral conduits 106 and 126 are provided to the conduit adapter flanges 94 and 96 by means of seal sleeves 104 and 132, respectively. The lateral conduits 106 and 126 are attached to the conduit adapter flanges 94 and 96, respectively by bolts 102 and 130.

Thus, as illustrated in FIG. 3, the "T" shaped bore of cylindrical gate 30 comprising the head of the "T" or through bore 50 and the base of the "T" 52 or perpendicular bore provide lateral communication between the vertical flow path via the head of the "T" passage 50 and the lateral conduit bore 108 as illustrated. As will be illustrated below, the gate 30 may be rotated among a number of angular positions whereby the perpendicular bore 52 may be aligned with the lower coupling member 62, and the through bore 50 may be aligned with the lateral conduit bores 109 and 108, or the portion of the gate having no bore through it 151 may be brought to a position where it covers lower coupling member 62 thereby preventing upward fluid flow from the lower coupling member.

Turning now to FIG. 4, the valve 10 is shown illustrated between a blowout preventer stack 150 and a wellhead 14. The valve 10 is illustrated in which the gate 30 is in its first lateral position, that is, entirely out of the intersection of the lateral housing passage 16 and the vertical housing passage 32. Thus, the tubing hanger pack-off 51 and tubing 39 may be run into the wellhead 14 and the lower part of the housing 12 of the valve 10 through the vertical bore of the blowout preventer 150 and the vertical housing passage 32. Also illustrated in FIG. 4 are wing or diverter valves 200 and 201 connected in conduits defining lateral conduit bores 108 and 109.

FIG. 5 illustrates the valve 10 after the gate has been moved into the intersection of the vertical housing passage 32 and the lateral housing passage 16. The gate has been angularly rotated by means of rotary actuator 42 until it is in the position illustrated in FIG. 5 which is called, for simplicity, the first angular position. In the first angular position the head of the "T" shaped passage in the gate 30 is aligned vertically to communicate with the lower bore 63 which is in communication with the tubing landed in the wellhead. The base of the "T" shaped passage 52 is aligned with one of the lateral conduit bores, in this case 109 (The first angular position may likewise be defined to be one hundred-eighty degrees from that illustrated in FIG. 5, that is, where the base of the "T" shaped passage 52 is aligned with the lateral outlet 108).

FIG. 6 illustrates the condition of the valve 10 where the gate 30 has been rotated to a second angular position, that is ninety degrees clockwise from that illustrated in FIG. 5. In this position where the cylindrical gate is in the second lateral position and in the second angular position, a portion 151 of the gate having no bore extending through it completely covers the lower bore 63 preventing vertical fluid flow from the tubing below.

FIG. 7 illustrates the orientation of the cylindrical gate in the second lateral position and in a third angular position, that is where the gate 30 has been rotated ninety degrees counterclockwise from that illustrated in FIG. 5. In this orientation, the cylindrical gate provides a lateral fluid path via the head of the "T" shaped passage in the gate 30, to lateral outlets 109 and 108 via the base of the "T" shaped passage from the tubing in the well. Thus, by means of diverter valves 200 and 201, the fluid flow may be controlled or may be prevented from flowing from the tubing in the wellhead 14.

In either the second angular position of FIG. 6 or the third angular position of FIG. 7, vertical fluid flow may be completely prevented, thereby allowing the blowout preventer stack 150 to be removed from the housing of the valve and to be replaced thereby with a vertical Christmas tree by means of an adapter flange 76 as illustrated in FIG. 2.

Turning now to FIG. 8, the valve 10 is illustrated as it may be used as a master valve of a lateral production or Christmas tree. Cap 210 is attached to the valve housing and prevents vertical flow via upper housing passage. The valve condition is shown similar or in the same position as that of FIG. 7, that is where the head of the "T" shaped passage of the gate 30 is aligned with lateral outlets 108 and 109. Thus, in a normal production mode, the production flow may be controlled by means of diverter valves, in this case control valves, 200 or 201. The gate 30 may be rotated one hundred-eighty degrees from that illustrated in FIG. 8 to completely close off the vertical flow path of the well thereby acting as a master valve.

FIG. 9 illustrates the safety valve 10 attached to a wellhead 14 after a Christmas tree 220 with a master valve 222 has been attached to the top of the valve. The valve illustrated in FIG. 9 is shown with the gate 30 turned to an angular position such that the vertical flow path from the tubing in the wellhead 14 is closed.

FIG. 10 illustrates the valve of FIG. 9 where a master valve 222 of a Christmas tree 220 has been attached to its top. A swab valve 230 and lubricator adapter 240 have been attached to the top of the Christmas tree whereby swabbing or wireline operations may be conducted through the Christmas tree, through the valve 10 and into the tubing of the well. The gate 30 is oriented as illustrated allowing a vertical flow path into the well.

The safety valve described above may be used as a production platform diverter for installation on an offshore well above the tubing head and below the Christmas tree. As described previously, it may be used during completion or workover of the well where the production platform diverter has a full open bore to run drills, hangers or other large diameter devices into the well. During normal production, the production platform diverter has a small through production bore which is sealed off from the large vertical passage. Should the need arise, a production flow may be diverted away from the platform via the side outlets of the valve and the vertical bore to the Christmas tree may be sealed off by remote control operation of the diverter. The diverter as discussed above may also be used to shut in the well.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A valve comprising, a housing having a vertical housing passage and a lateral housing passage, said vertical and lateral passages intersecting each other, a cylindrical gate disposed in said lateral passage, said gate having a first gate passage disposed through it of a diameter smaller than that of said vertical housing passage, means for laterally moving said gate within said lateral passage between two lateral positions:

a first lateral position where said gate is in the intersection of the vertical housing passage and the lateral housing passage, and a second lateral position where the gate is out of the intersection of the vertical housing passage, thereby allowing full diameter access through the vertical housing passage, and means for angularly rotating said cylindrical gate when it is in the first lateral position for angularly orientating said gate between at least two angular positions:

a first angular position where said first gate passage is coaxial with said vertical housing passage thereby allowing fluid flow from a lower portion of the vertical housing passage to an upper portion of the vertical housing passage via the first gate passage, and a second angular position where a portion of said gate having no passage through it prevents upward fluid flow from a lower portion of the vertical housing passage via said gate passage.

2. The valve of claim 1 further comprising, means for disposing upper and lower conduits in said vertical housing passage, the upper conduit having its lower end open to the intersecting lateral passage, the lower conduit having its upper end open to the intersecting lateral passage, whereby when said gate is in said first lateral position and in said first angular position, said first gate passage is aligned with said upper and lower conduits and an upward flow path is established through said conduits and said gate passage, and when said gate is in said first lateral position and in said second angular position, upward flow from said lower conduit is prevented.

3. The valve of claim 2 further comprising, at least one lateral outlet in said housing, said lateral outlet being substantially perpendicular to said vertical housing passage and to said lateral housing passage and being open to the intersection of the lateral housing passage and the vertical housing passage, and a second gate passage perpendicular to and communicating with said first gate passage, said first and second gate passages forming a "T" shaped passage, the first gate passage forming the head of the "T", the second gate passage forming the base of the "T", and wherein when said gate is in said first lateral position and in said first angular position, said second gate passage is aligned with said lateral outlet.

4. The valve of claim 3 further comprising a second lateral outlet in said housing, said second lateral outlet being substantially perpendicular to said vertical housing passage and to said lateral housing passage and being open to the intersection of the lateral housing passage and the vertical housing passage and being spaced one hundred eighty degrees about the housing from said first lateral outlet, and wherein said angular rotating means is adapted to rotate said cylindrical gate among said first and second positions and a third position:

the third position where said head of the "T" shaped passage is aligned with said first and second lateral outlets and said base of the "T" shaped passage is aligned with said lower conduit.

5. The valve of claim 3 further comprising a diverter valve attached to the lateral outlet.

6. The valve of claim 4 further comprising two diverter valves, one each attached to each of the two lateral outlets.

7. The valve of claim 1 further comprising orientation means for preventing angular rotation of said gate while in the second lateral position and during transit of said gate from said second lateral position to said first lateral position and for allowing angular rotation of said gate while in said first lateral position.

8. A safety valve comprising, a housing having coaxial upper and lower vertical housing passages and a lateral housing passage, said lateral passage intersecting said upper vertical housing passage and said lower vertical housing passage, a laterally movable cylindrically shaped gate disposed in said lateral housing passage, the lateral length of said gate being less than the lateral length of said lateral housing passage extending outwardly from said upper and lower vertical housing passages, whereby when said gate is disposed in a second lateral position within the outwardly extending part of the lateral housing, the upper and lower vertical passages are unobstructed by said gate thereby providing full diameter vertical access via said upper vertical housing passage to said lower vertical passage, said gate being angularly movable within said lateral housing passage and having a through bore therein, whereby when said gate is disposed in a first lateral position in the intersection of the vertical housing passages and the lateral housing passage, said bore may be in a first angular position in alignment with said coaxial upper and lower housing passages, or in a second angular position where said gate is rotated in one direction from the first angular position, or in a third angular position where said gate is rotated in the other direction from the first angular position, means for laterally moving said gate between said first and second position, and means for angularly rotating said gate among said first, second and third angular positions.

9. The safety valve of claim 8 further comprising, means for disposing upper and lower conduits in said vertical housing passage, the upper conduit having its lower end open to the intersecting lateral passage, the lower conduit having its upper end open to the intersecting lateral passage, two diametrically opposed lateral outlets substantially perpendicular to said vertical housing passage and to said lateral housing passage, each outlet being open to the intersection of the lateral housing passage and the vertical housing passage, and a second bore in said gate perpendicular to said through bore and intersecting said through bore forming a "T" shaped passage, the through bore forming the head of the "T", the second bore forming the base of the "T", whereby, when said gate is in said first lateral position and in said first angular position, the head of the "T" passage is aligned with the upper and lower conduits and said base of the "T" is aligned with one of the lateral outlets, whereby, when said gate is in said first lateral position and in said second angular position, said head of the "T" passage is aligned with said lateral outlets and a portion of the gate having no passage extending through its wall covers the lower conduit thereby preventing upward fluid flow from said lower conduit, and whereby, when said gate is in said first lateral position and in said third angular position, said head of the "T" passage is aligned with said lateral outlets and the base of the "T" passage is aligned with said lower conduit thereby allowing fluid flow from said lower conduit to said lateral outlets.

10. The valve of claim 9 further comprising diverter valves disposed in conduits extending from said lateral outlets.

11. A production tree for use with an oil and gas well comprising a master valve adapted for connection to the tubing head of the well having, a housing having coaxial upper and lower vertical housing passages and a lateral housing passage, said lateral passage intersecting said upper vertical housing passage and said lower housing passage, and two lateral outlets in said housing, said lateral outlets being substantially perpendicular to said vertical housing passage and to said lateral housing passage and being open to the intersection of the lateral housing passage and to the vertical housing passage, a laterally movable cylindrically shaped gate disposed in said lateral housing passage, the lateral length of said gate being less than the lateral length of said lateral housing passage extending outwardly from said upper and lower vertical housing passages, whereby when said gate is disposed in a second lateral position within the outwardly extending part of the lateral housing passage, said upper and lower vertical housing passages are unobstructed by said gate thereby providing full diameter vertical access via said upper vertical housing passage to said lower vertical passage, means for coupling production tubing landed in said tubing head with the lower housing passage of said master valve, said gate being angularly movable within said lateral housing passage and having a through bore therein and a second bore in said bore in said gate perpendicular to said through bore and intersecting said through bore forming a "T" shaped passage, the through bore forming the head of the "T", the second bore forming the base of the "T", whereby when said gate is disposed in a first lateral position in the intersection of the vertical housing passages and the lateral housing passage, and in a first angular position, the head of the "T" passage is aligned with the lateral outlets and the base of the "T" passage is aligned with the production tubing, thereby allowing flow between the production tubing and the lateral outlets, and in a second angular position, a portion of the gate having no bore extending through it covers production tubing thereby preventing flow from said tubing, means for laterally moving said gate between said first and second positions, and control valve means attached to said lateral outlets for controlling fluid flow in the production tubing in the well.

12. The production tree of claim 11 further comprising means for attaching a blowout preventer to the upper passage of said housing, whereby control over the well is maintained during workover operations when said gate is in said second lateral position.

13. The production tree of claim 11 further comprising, means for capping said vertical housing passage of said housing.

14. A gate adapted for use in a valve housing with a vertical housing passage and a lateral housing passage, said vertical and lateral passages intersecting each other, the gate comprising, a cylindrical member adapted for placement within said lateral housing passage and having a first gate passage disposed through said cylindrical member and having a substantially circular cross-section of a diameter smaller than that of said vertical housing passage, said gate after assembled for operation within said valve housing being adapted to be laterally moveable into and out of the intersection of said vertical and lateral housing passages and angularly movable within said lateral housing passage.

15. The gate of claim 14 further comprising, a second gate passage perpendicular to and communicating with said first gate passage, said first and second gate passages forming a "T" shaped passage, the first gate passage forming the head of the "T", the second gate passage forming the base of the "T".

16. In a well having a wellhead to which is attached a safety valve housing having an upper vertical housing passage and a lower vertical housing passage, the lower passage communicating with the wellhead, and each of the upper and lower vertical passages being open to a lateral passage in the housing, a laterally movable cylindrical gate disposed in said lateral passage, said gate having a first gate passage disposed through it of a diameter smaller than that of said vertical upper and lower passage, and means for laterally moving said gate within said lateral passage between a first lateral position where said gate is in the intersection of the upper and lower vertical passages and the lateral housing passage and second lateral position where the gate is out of the intersection of the vertical housing passage, and means for angularly moving said gate when in the first lateral position to a first angular position where said first gate passage is aligned with said upper and lower vertical housing passages or to a second angular position where said first gate passage is rotated substantially ninety degrees from the first angular position, the housing having a blowout preventer removably attached to the upper part of the housing with the vertical flow path of the blowout preventer communicating with the upper vertical housing passage of the safety valve, the diameter of the vertical flow path of the blowout preventer being substantially the same as or greater than that of the upper and lower vertical housing passages of the safety valve, a method for controlling the well during installation of production tubing and a Christmas tree comprising the steps of, setting tubing in the well through the blowout preventer and upper and lower vertical housing passages while the cylindrical gate is in the second lateral position, laterally moving the gate to the first lateral position, angularly moving the gate to the second angular position until the vertical fluid flow path to the upper vertical housing passage from the tubing is closed vertically, removing the blowout preventer from the upper part of the housing, installing a Christmas tree to the upper part of the housing, and angularly moving the gate to the first angular position where the first gate passage completes the vertical flow path from the tubing in the wellhead below to the Christmas tree above the safety valve housing.

17. The method of claim 16 wherein the gate has a second gate passage perpendicular to and communicating with said first gate passage, said first and second gate passages forming a "T" shaped passage, the first gate passage forming the head of the "T", the second gate passage forming the base of the "T", the housing having two lateral outlets being substantially perpendicular to said upper and lower vertical passages and to said lateral housing passage, each of the outlets being open to the intersection of the lateral housing passage and the upper and lower passages, and a diverter valve being attached to each of said outlets, and the step of angularly moving the gate to the second angular position to close the fluid flow path to the upper vertical housing passage comprises moving the gate angularly within the lateral passage until the head passage of the "T" is aligned with said lateral outlets from the housing and said base passage of the "T" is aligned with said tubing, and a portion of the upper surface of the gate having no passage extending through it covers the flow path to the upper passage of the housing.

18. The method of claim 17 further comprising the step of opening one or both of the diverter valves whereby fluid in said tubing may be diverted away from said wellhead.

* * * * *